US010370746B2

(12) United States Patent
Allain et al.

(10) Patent No.: US 10,370,746 B2
(45) Date of Patent: Aug. 6, 2019

(54) PROCESS FOR MANUFACTURING STEEL SHEET

(71) Applicant: ARCELORMITTAL, Luxembourg (LU)

(72) Inventors: Sebastien Allain, Metz (FR); Audrey Couturier, Metz (FR); Thierry Iung, Jarny (FR); Christine Colin, Maizieres les Metz (FR)

(73) Assignee: ARCELORMITTAL, Luxembourg (LU)

( * ) Notice: Subject to any disclaimer, the term of this patent is extended or adjusted under 35 U.S.C. 154(b) by 134 days.

(21) Appl. No.: 15/711,335

(22) Filed: Sep. 21, 2017

(65) Prior Publication Data

US 2018/0010220 A1 Jan. 11, 2018

Related U.S. Application Data

(62) Division of application No. 12/281,839, filed as application No. PCT/FR2007/000256 on Feb. 14, 2007, now Pat. No. 9,856,548.

(30) Foreign Application Priority Data

Mar. 7, 2006 (EP) ..... 06290386

(51) Int. Cl.

| | |
|---|---|
| ***C21D 1/19*** | (2006.01) |
| ***C22C 38/02*** | (2006.01) |
| ***C21D 8/02*** | (2006.01) |
| ***C21D 9/32*** | (2006.01) |
| ***C21D 9/46*** | (2006.01) |
| ***C22C 38/04*** | (2006.01) |
| ***C22C 38/06*** | (2006.01) |
| ***C22C 38/12*** | (2006.01) |
| ***C22C 38/22*** | (2006.01) |
| ***C22C 38/34*** | (2006.01) |
| ***C22C 38/38*** | (2006.01) |

(52) U.S. Cl.

CPC ..... *C22C 38/02* (2013.01); *C21D 1/19* (2013.01); *C21D 8/02* (2013.01); *C21D 9/32* (2013.01); *C21D 9/46* (2013.01); *C22C 38/04* (2013.01); *C22C 38/06* (2013.01); *C22C 38/12* (2013.01); *C22C 38/22* (2013.01); *C22C 38/34* (2013.01); *C22C 38/38* (2013.01); *C21D 2211/002* (2013.01); *C21D 2211/008* (2013.01)

(58) Field of Classification Search

CPC ..... C21D 1/19; C22C 38/02
USPC ..... 148/547
See application file for complete search history.

(56) References Cited

U.S. PATENT DOCUMENTS

| | | | |
|---|---|---|---|
| 4,472,208 | A | 9/1984 | Kunishige |
| 5,545,269 | A | 8/1996 | Koo et al. |
| 5,695,576 | A | 9/1997 | Beguinot |
| 6,212,891 | B1 | 4/2001 | Minta et al. |
| 6,254,698 | B1 | 7/2001 | Koo et al. |
| 6,364,968 | B1 | 4/2002 | Yasuhara et al. |
| 7,749,343 | B2 | 7/2010 | Yoshinaga et al. |
| 2005/0081966 | A1 | 4/2005 | Kashima et al. |
| 2005/0150580 | A1 | 7/2005 | Akamizu et al. |
| 2006/0137768 | A1 | 6/2006 | Yuse et al. |
| 2006/0162825 | A1 | 7/2006 | Beguinot |

FOREIGN PATENT DOCUMENTS

| | | | |
|---|---|---|---|
| CN | 1190997 | | 8/1998 |
| CN | 1547620 | | 11/2004 |
| EP | 0725156 | | 8/1996 |
| EP | 1512760 | | 3/2005 |
| FR | 2847273 | | 5/2004 |
| JP | H05195143 | A | 8/1993 |
| JP | H10298648 | | 11/1998 |
| JP | H1180890 | A | 3/1999 |
| JP | H11269606 | | 10/1999 |
| JP | 2003193193 | A | 7/2003 |
| JP | 2004190050 | A | 7/2004 |
| JP | 2004190063 | | 7/2004 |
| JP | 2004332100 | | 11/2004 |
| RU | 2152450 | | 7/2000 |
| RU | 2200920 | | 3/2003 |
| RU | 2235792 | | 9/2004 |
| WO | 2004048631 | | 6/2004 |

OTHER PUBLICATIONS

Sugimoto. K. et al., "Stretch-Flangeability of a High-Strength Trip Type Bainitic Sheet Steel", ISIJ International, vol. 40, No. 9, pp. 920-926 (2000).

*Primary Examiner* — Edward M Johnson
(74) *Attorney, Agent, or Firm* — Davidson, Davidson & Kappel, LLC

(57) ABSTRACT

The invention relates to a hot-rolled steel sheet having a tensile strength of greater than 1200 MPa, an $R_e/R_m$ ratio of less than 0.75 and an elongation at break of greater than 10%, the composition of which contains, the contents being expressed by weight: 0.10%≤C≤0.25%; 1%≤Mn≤3%; Al≥0.015%; Si≤1.985%; Mo≤0.30%; Cr≤1.5%; S≤0.015%; P≤0.1%; Co≤1.5%; B≤0.005%; it being understood that 1%≤Si+Al≤2%; Cr+(3×Mo)≥0.3%, the balance of the composition consisting of iron and inevitable impurities resulting from the smelting, the microstructure of the steel consisting of at least 75% bainite, residual austenite in an amount equal to or greater than 5% and martensite in an amount equal to or greater than 2%.

11 Claims, 2 Drawing Sheets

PROCESS FOR MANUFACTURING STEEL SHEET

Figure 1:
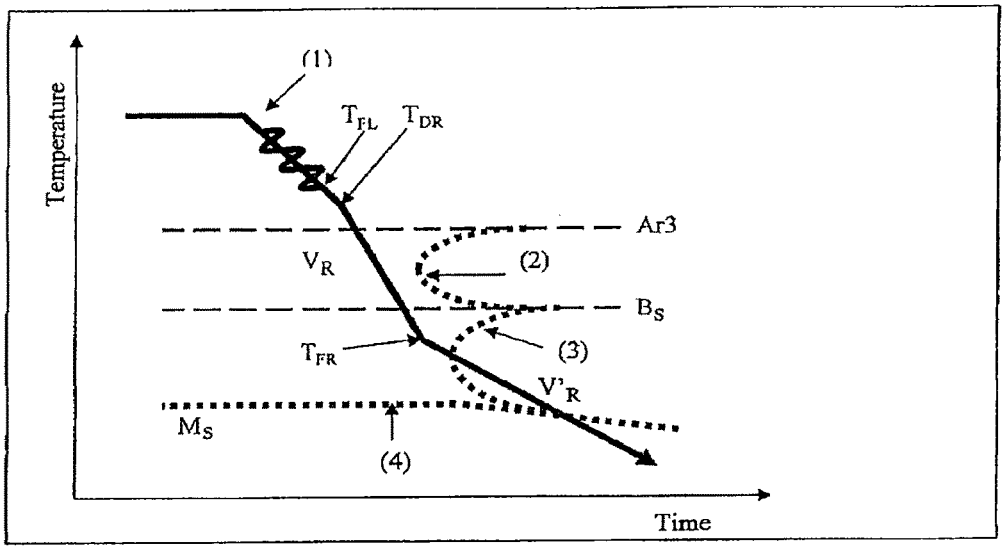

The invention relates to the manufacture of hot-rolled sheet made of steel called "multiphase" steel exhibiting simultaneously a very high tensile strength and a deformability allowing cold-forming operations to be carried out. The invention relates more precisely to steels of predominantly bainitic microstructure having a tensile strength of greater than 1200 MPa end a yield strength/tensile strength ratio of less than 0.75. The automotive sector and general industry in particular constitute fields of application for such hot-rolled steel sheet.

In the automotive industry in particular, there is a continuous need to lighten vehicles and to increase safety. Thus, several families of steels offering various strength levels have been proposed.

Firstly, steels have been proposed that have microalloy elements whose hardening is obtained simultaneously by precipitation and by refinement of the grain size. The development of such steels has been followed by that of "dual-phase" steels in which the presence of martensite within a ferritic matrix allows a tensile strength of greater than 450 MPa together with good cold formability to be obtained.

For the purpose of obtaining even higher tensile strength levels, steels exhibiting TRIP (Transformation Induced Plasticity) behaviour with highly advantageous combinations of properties (tensile strength/deformability) have been developed. These properties are associated with the structure of such steels, which consists of a ferritic matrix containing bainite and residual austenite. The residual austenite is stabilized by an addition of silicon or aluminium, these elements retarding the precipitation of carbides in the austenite and in the bainite. The presence of residual austenite gives an undeformed sheet high ductility. Under the effect of a subsequent deformation, for example when stressed uniaxially, the residual austenite of a part made of TRIP steel is progressively transformed to martensite, resulting in substantial hardening and delaying the appearance of necking.

To achieve an even higher tensile strength, that is to say a level greater than 800-1000 MPa, multiphase steels having a predominantly bainitic structure have been developed. In the automotive industry or in industry in general, such steels are advantageously used for structural parts such as bumper cross-members, pillars, various reinforcements and abrasion-resistant wear parts. However, the formability of these parts requires, simultaneously, a sufficient elongation, greater than 10% and not too high a yield strength/tensile strength ratio so as to have a sufficient reserve of plasticity.

U.S. Pat. No. 6,364,958 discloses the manufacture of hot-rolled sheet made of steel microalloyed with niobium or titanium, having a tensile strength greater than 780 MPa, of bainitic structure or bainitic/martensitic structure containing at least 90% bainite, with a grain size of less than 3 microns. The exemplary embodiments in the patent show that the tensile strength obtained exceeds barely 1200 MPa, together with an $R_e/R_m$ ratio of greater than 0.75. It should also be noted that the carbides present in this type of very predominantly bainitic structure result in mechanical damage when being stressed, for example in hole expansion tests.

U.S. Pat. No. 4,472,208 also discloses the manufacture of hot-rolled sheet made of steel microalloyed with titanium having a predominantly bainitic structure, containing at least 10% ferrite and preferably 20 to 50% ferrite, and titanium carbide (TiC) precipitation. Because of the large quantity of ferrite, the tensile strength of the grades manufactured according to that invention is however less than 1000 MPa, which value may be insufficient for some applications.

Patent JP 2004332100 discloses the manufacture of hot-rolled steel sheet having a tensile strength of greater than 800 MPa, of predominantly bainitic structure, containing less than 3% residual austenite. However, costly additions of niobium, must be made so as to obtain high tensile strength values.

Patent JP 2004190063 discloses the manufacture of hot-rolled steel sheet having a high tensile strength, the product of the tensile strength multiplied by the elongation being greater than 20,000 MPa. %, and containing austenite. However, such steel contains costly additions of copper, relative to the sulphur content.

The object of the present invention is to solve the above-mentioned problems. Its aim is to make available a hot-rolled steel exhibiting a tensile strength of greater than 1200 MPa together with good cold formability, an $R_e/R_m$ ratio of less than 0.75 and an elongation at break of greater than 10%. The aim of the invention is also to provide a steel that is largely insensitive to damage when being cut by a mechanical process.

The aim of the invention is also to provide a steel having good toughness so as to withstand the sudden propagation of a defect, especially when being dynamically stressed. The aim is to achieve a Charpy V fracture energy in excess of 28 joules at 20° C. The aim of the invention is also to provide a steel exhibiting good weldability when welded by means of standard assembly methods within the thickness range from 1 millimeter to more than 3D, especially during spot resistance welding or arc welding, in particular MAG (Metal Active Gas) welding. The invention also aims to provide a steel whose composition does not include costly microalloy elements such as titanium, niobium or vanadium. In this way, the manufacturing cost is lowered and the thermomechanical manufacturing schemes are simplified. Its aim is also to provide a steel exhibiting a very high fatigue endurance limit. In addition, the aim of the invention is to provide a manufacturing process in which small variations in the parameters do not cause substantial modifications to the microstructure or to the mechanical properties.

For this purpose, one subject of the invention is a hot-rolled steel sheet having a tensile strength of greater than 1200 MPa, an $R_e/R_m$ ratio of less than 0.75 and an elongation at break of greater than 10%, the composition of which contains, the contents being expressed by weight: $0.10\% \leq C \leq 0.25\%$; $1\% \leq Mn \leq 3\%$; $Al \geq 0.015\%$; $Si \leq 1.985\%$; $Mo \leq 0.30\%$; $Cr \leq 1.5\%$; $S \leq 0.015\%$; $P \leq 0.1\%$; $Co \leq 1.5\%$; $B \leq 0.005\%$; it being understood that $1\% \leq Si+Al \leq 2\%$; $Cr+(3\times Mo) \geq 0.3\%$, the balance of the composition consisting of iron and inevitable impurities resulting from the smelting, the microstructure of the steel consisting of at least 75% bainite, residual austenite in an amount equal to or greater than 5% and martensite in an amount equal to or greater than 2%.

Preferably, the carbon content of the steel sheet is such that: $0.10\% \leq C \leq 0.15\%$.

Also preferably, the carbon content is such that; $0.15\% < C \leq 0.17\%$.

According to a preferred embodiment, the carbon content is such that: $0.17\% < C \leq 0.22\%$.

Preferably, the carbon content is such that: $0.22\% < C \leq 0.25\%$.

According to a preferred embodiment the composition of the steel comprises; $1\% \leq Mn \leq 1.5\%$.

Also preferably, the composition of the steel is such that: $1.5\% < Mn \leq 2.3\%$.

Preferably, the composition of the steel comprises: 2.3%≤MP≤3%.

According to a preferred embodiment, the composition of the steel comprises; 1.2%≤Si≤1.8%.

Preferably, the composition of the steel comprises: 1.2%≤Al≤1.8%.

According to a preferred embodiment, the composition of the steel is such that; Mo≤0.010%.

Another subject of the invention is a steel sheet, the carbon content of the residual austenite of which is greater than 1% by weight.

Another subject of the invention is a steel sheet containing carbides between the bainite laths, the number N of inter-lath carbides of size greater than 0.1 micron per unit area being equal to 50,000/mm$^2$ or less.

Another subject of the invention is a steel sheet containing martensite/residual austenite islands, the number $N_{MA}$ per unit area of martensite/residual austenite islands having a maximum size $L_{max}$ greater than 2 microns and having an elongation factor $L_{max}/L_{min}$ less than 4 being less than 14,000/mm$^2$.

Another subject of the invention is a process for manufacturing a hot-rolled steel sheet having a tensile strength of greater than 1200 MPa, an $R_e/R_m$ ratio of less than 0.75 and an elongation at break of greater than 10%, in which:

a steel of the above composition is supplied;

a semi-finished product is cast from this steel;

the semi-finished product is heated to a temperature above 1150° C.;

the semi-finished product is hot-rolled in a temperature range in which the structure of the steel is entirely austenitic;

then the sheet thus obtained is cooled from a temperature $T_{DR}$ lying above Ar3 down to a transformation temperature $T_{FR}$ in such a way that the primary cooling rate $V_R$ between $T_{DR}$ and $T_{FR}$ is between 50 and 90° C./s and the temperature $T_{FR}$ s between $B'_S$ and $M_S$+50° C., B's denoting a temperature defined relative to the bainite transformation start temperature $B'_S$, and $M_S$ denoting the martensite transformation start temperature, then the sheet is cooled from the temperature $T_{FR}$ at a secondary cooling rate $V'_R$ between 0.08° C./min and 600° C./min down to the ambient temperature;

the temperature $B'_S$ being equal to $B_S$ when the rate $V'_R$ is between 0.08 and 2° C./min and the temperature $B'_S$ being equal to $B_S$+60° C. when the rate $V'_R$ is greater than 2° C./min but does not exceed 600° C./min.

Another subject of the invention is a process for manufacturing a hot-rolled steel, sheet having a tensile strength of greater than 1200 MPa, an $R_e/R_m$ ratio of less than 0.75 and ah elongation at break of greater than 10%, in which:

a steel of the above composition is supplied;

a semi-finished product is cast from this steel;

the semi-finished product is heated to a temperature above 1150° C. and is hot-rolled in a temperature range in which the microstructure of the steel is entirely austenitic; then;

the sheet thus obtained is cooled from a temperature $T_{DR}$ lying above Ar3 down to an intermediate temperature $T_I$ at a cooling rate of 70° C./s or higher, the temperature hot exceeding 650° C.; then the sheet is cooled from the temperature $T_I$ down to a temperature $T_{FR}$, the temperature $T_{FR}$ being between $B'_S$ and $M_S$+50° C., $B'_S$ denoting a temperature defined relative to the bainite transformation start temperature $T_{DR}$ and $M_S$ denoting the martensite transformation start temperature, in such a way that the cooling rate between the temperature $T_{DR}$ and the temperature $T_{FR}$ is between 20 and 90° C./s; then the sheet is cooled from the temperature $T_{FR}$ at a secondary cooling rate $V'_R$ between 0.08° C./min and 600° C./min down to the ambient temperature;

the temperature $B'_S$ being equal to $B_S$+60° C. when the rate is between 0.08 and 2° C./min; and the temperature $B'_S$ being equal to $B_S$+60° C. when the rate $V'_R$ is greater than 2° C./min but does not exceed 600° C./min.

Another subject of the invention is a process for manufacturing a hot-rolled steel sheet in which:

a steel of the above composition is supplied;

a semi-finished product is cast from this steel;

the semi-finished product is heated to a temperature above 1150° C.;

the semi-finished product is hot-rolled in a temperature range in which the structure of the steel is entirely austenitic; and the primary cooling start temperature $T_{DR}$ lying above Ar3, the primary cooling finish temperature $T_{FR}$, the primary cooling rate $V_R$ between $T_{DR}$ and $T_{FR}$ and the secondary cooling rate $V'_R$ are adjusted in such a way that the micros true tare of the steel consists of at least 75% bainite, residual austenite in an amount equal to or greater then 5% and martensite in an amount equal to or greater than 2%.

Another subject of the invention is a manufacturing process in which the primary cooling start temperature $T_{DR}$ lying above Ar3, the primary cooling finish temperature $T_{FR}$, the primary cooling rata $V_R$ between $T_{DR}$ and $T_{FR}$ and the secondary cooling rate $V'_R$ are adjusted in such a way that the carbon content of the residual austenite is greater than 1% by weight.

Another subject of the invention is a process in which the primary cooling start temperature lying above Ar3, the primary cooling finish temperature $T_{FR}$, the primary cooling rate $V_R$ between $T_{DR}$ and $T_{FR}$ and the secondary cooling rate $V'_R$ are adjusted in such a way that the number of inter-lath carbides having a size greater than 0.1 microns per unit area does not exceed 50,000/mm$^2$.

Another subject of the invention is a process in which the primary cooling start, temperature $T_{DR}$ lying above Ar3, the primary cooling finish temperature $T_{FR}$, the primary cooling rate $V_R$ between $T_{DR}$ and $T_{FR}$ and the secondary cooling rate $V'_R$ are adjusted in such a way that the number $N_{MA}$ per unit area of martensite/residual austenite islands having a maximum size $L_{max}$ greater than 2 microns and an elongation factor $L_{max}/L_{min}$ less than 4 is less than 14,000/mm$^2$.

Another subject of the invention is the use of a hot-rolled steel sheet according to the features described above, or manufactured by a process according to one of the above embodiments, for the manufacture of structural parts or reinforcing elements in the automotive field.

Another subject of the invention is the use of a hot-rolled steel sheet according to the features described above, or manufactured by a process according to one of the above embodiments, for the manufacture of reinforcements and structural parts for general industry and of abrasion-resistant parts.

Figure 2:
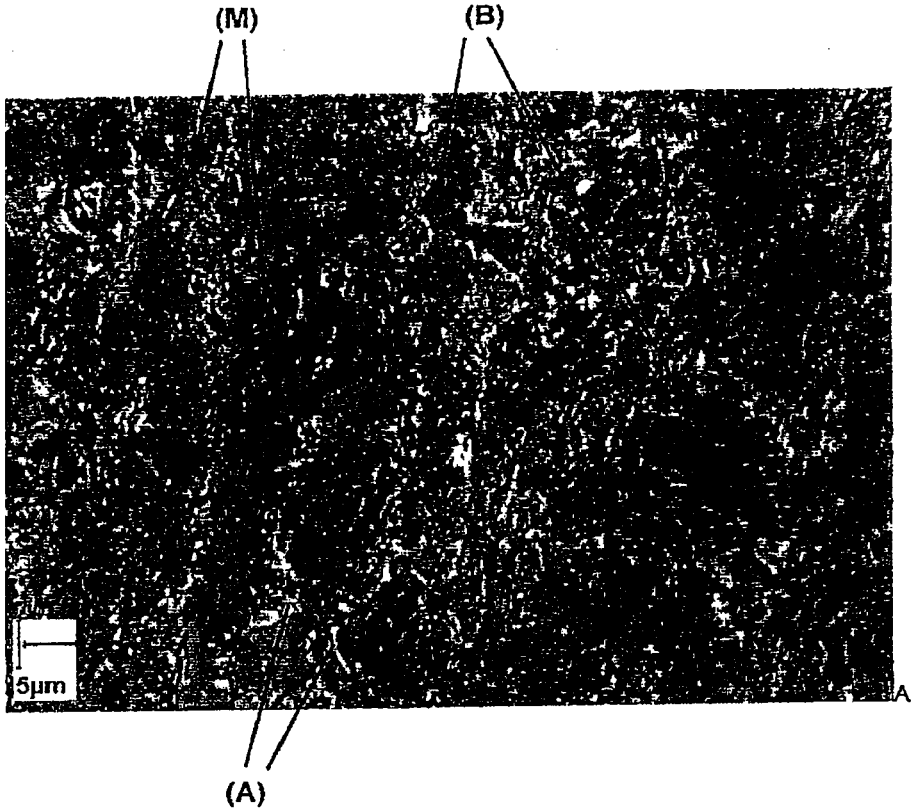

Other features and advantages of the invention will become apparent over the course of the description below, given by way of example and with reference to the figures appended hereto, in which:

FIG. 1 is a schematic representation of one embodiment of the manufacturing process according to the invention, relating to a transformation diagram starting from austenite; and FIG. 2 shows an example of the microstructure of a steel sheet according to the indention.

Under standard cooling conditions after hot rolling, a steel containing about 0.2% and 1.5% Mn is transformed, upon cooling from austenite, into bainite composed of ferrite laths and carbides. In addition, the microstructure may contain a relatively large amount of proeutectoid ferrite formed at a relatively nigh temperature. However, the yield point of this constituent is low, so that it is not possible to obtain a very high tensile strength level when this constituent is present. The steels according to the invention contain no proeutectoid ferrite. In this way, the tensile strength is substantially increased, to beyond 1200 MPa. Thanks to the compositions according to the invention, the precipitation of inter-lath carbides is also retarded and the micro-structure then consists of bainite, residual austenite and martensite resulting from the transformation of the austenite. The structure also has an appearance consisting of fine bainite packets (a packet denoting an assembly of parallel laths within the same original austenitic grain), the tensile strength and ductility of which are greater than those of polygonal ferrite. The size of the bainite laths is of the order of a few hundred nanometers and the size of the lath packets is of the order of a few microns.

As regards the chemical composition of the steel, carbon plays a very important role in the formation of the microstructure and in the mechanical properties. Starting from an austenitic structure formed at high temperature after hot-rolling a sheet, a bainite transformation takes place and bainitic ferrite laths are initially formed within a still predominantly austenitic matrix. Because of the much lower solubility of carbon in ferrite compared to that in austenite, the carbon is rejected between the laths. Thanks to certain alloy elements present in the compositions according to the invention, in particular thanks to the combined additions of silicon and aluminium, very limited precipitation of carbides, especially cementite, takes place. Thus, the not yet transformed inter-lath austenite is progressively enriched with carbon practically without any significant precipitation of carbides occurring at the austenite/bainite interface. This enrichment is such that the austenite is stabilized, that is to say the martensite transformation of most of this austenite practically does not take place upon cooling down to the ambient temperature. A small amount of martensite does appear in the form of islands, contributing to the increase in tensile strength.

Carbon also retards the formation of proeutectoid ferrite, the presence of which must be avoided in order to obtain high tensile strength levels.

According to the invention, the cartoon content is between 0.10 and 0.25% by weight. Below 0.10%, a sufficient tensile strength cannot be obtained and the stability of the residual austenite is unsatisfactory.

Above 0.25%, the voidability is reduced owing to the formation of low-toughness microstructures in the heat-affected affected zone or in the melted zone under autogenous welding conditions.

According to a first embodiment, the carbon content is between 0.10 and 0.15%. Within this range, the weldability is very satisfactory and the toughness obtained is particularly high. Manufacture by continuous casting is particularly easy owing to a favourable mode of solidification.

According to a second preferred embodiment, the carbon content is greater than 0.15% but does not exceed 0.17%. Within this range, the weldability is satisfactory and the toughness obtained is high.

According to a third preferred embodiment, the carbon content is greater than 0.17% but does not exceed 0.22%. This compositional range optimally combines tensile strength properties on the one hand with ductility, toughness and weldability properties on the other.

According to a fourth preferred embodiment, the carbon content is greater than 0.22% but does not exceed 0.25%. In this way, the highest tensile strength levels are obtained at the cost of a slight reduction in toughness.

When added in an amount between 1 and 3% by weight, manganese, an element promoting formation of the γ-phase, stabilizes the austenite by lowering the transformation temperature Ar3. Manganese also contributes to deoxidizing the steel during the smelting in the liquid phase. The addition of manganese also contributes to effective solid-solution hardening and to achieving a higher tensile strength. Preferably, the manganese content is between 1 and 1.5%. In this way, satisfactory hardening is combined with no risk of the formation of a deleterious banded structure. Also preferably, the manganese content is greater than 1.5% but does not exceed 2.3%. In this way, the above desired effects are obtained without a corresponding excessive increase in quench hardenability in welded assemblies. Also preferably, the manganese content is greater than 2.3% but does not exceed 3%. Above 3%, the risk of carbide precipitation, or the risk of forming deleterious banded structures, becomes too high. Under the conditions defined according to the invention, in combination with molybdenum and/or chromium additions, a tensile strength of greater than 1300 MPa may be obtained.

According to the invention, silicon and aluminium jointly play an important role.

Silicon inhibits the precipitation of cementite when cooling from austenite, by considerably retarding the growth of carbides. This derives from the fact that the solubility of silicon in cementite is very low and that this element increases the activity of carbon in austenite. In this way, if any cementite nucleus were to form at the ferrite/austenite interface, silicon would be rejected at the interface. The activity of the carbon is then increased in this silicon-enriched austenitic zone. The growth of cementite is then retarded since the carbon gradient between the cementite and the adjacent austenitic zone is reduced. An addition of silicon therefore helps to stabilize a sufficient amount of residual austenite in the form of thin films that locally increase the resistance to damage and that prevent the formation of embrittling carbides.

Aluminium is a very effective element for deoxidizing steel. For this purpose, its content is 0.015% or higher. Like silicon, it has a very low solubility in cementite and it stabilizes the residual austenite.

It has been demonstrated that the effects of aluminium and of silicon on the stabilization of austenite are very similar. When the silicon and aluminium contents are such that $1\% \leq Si+Al \leq 2\%$, satisfactory stabilization of the austenite is achieved, allowing the desired microstructures to be formed while maintaining satisfactory usage properties. Owing to the fact that the minimum aluminium content is 0.015%, the silicon content does not exceed 1.985%.

Preferably, the silicon content is between 1.2 and 1.8%. In this way, carbide precipitation is avoided and excellent weldability is obtained—no cracking is observed in MAG welding, with a sufficient latitude in terms of welding parameters. Welds produced by spot resistance welding are also free of defects. Moreover, since silicon stabilizes the ferritic phase, an amount of 1.8% or less prevents the formation of undesirable proeutectoid ferrite. An excessive addition of silicon also causes the formation of highly adherent oxides and the possible appearance of surface defects, resulting in particular in a lack of wettability in hot-dip galvanizing operations.

Also preferably, these effects are obtained when the aluminium content is between 1.2 and 1.8%. At equivalent content, the effects of aluminium are very similar to those mentioned above in the case of silicon. However, the risk of surface defects appearing is reduced.

Molybdenum retards the bainite transformation, contributes to solid-solution hardening and also refines the size of the bainite laths formed. According to the invention, the molybdenum content does not exceed 0.3% so as to avoid excessive formation of hardening structures.

In an amount of less than 1.5%, chromium has an effect very similar to molybdenum since it also contributes to the prevention of proeutectoid ferrite formation and to the hardening and refinement of the bainitic microstructure.

According to the invention, the chromium and molybdenum contents are such that; $Cr+(3\times Mo)\geq 0.3\%$. The chromium and molybdenum coefficients in this relationship result in the relatively high respective capability of these two elements to retard the ferrite transformation—when the above inequality is satisfied, the formation of proeutectoid ferrite is avoided under the specific cooling conditions according to the invention.

However, molybdenum is a costly element. The inventors have demonstrated that it is possible to manufacture a steel particularly economically by limiting the molybdenum content to 0.010% and by compensating for this reduction by an addition of chromium so as to satisfy the relationship: $Cr+(3\times Mo)\geq 0.3\%$.

Sulphur, in an amount of greater than 0.015%, tends to precipitate excessively in the form of manganese sulphides, which greatly reduce the formability.

Phosphorus is an element known to segregate at the grain boundaries. Its content must be limited to 0.1% so as to maintain sufficient hot ductility. The sulphur and phosphorus limitations also allow good voidability to be obtained in spot welding.

The steel may also contain cobalt. In an amount not exceeding 1.5%, this hardening element allows the carbon content in the residual austenite to be increased. However, the amount must also be limited for cost reasons.

The steel may also contain boron in an amount not exceeding 0.005%. Such an addition increases the quench hardenability and contributes to the elimination of proeucectoid ferrite. It also helps to increase the tensile strength levels.

The balance of the composition consists of inevitable impurities resulting from the smelting, such as for example nitrogen.

According to the invention, the microstructure of the steel consists of at least 75% bainite, residual austenite in an amount equal to or greater than 5% and martensite in an amount equal to or greater than 2%, these contents referring to percentages per unit area. This predominantly bainitic structure, with no proeutectoid ferrite, gives a very high resistance to subsequent mechanical damage.

The microstructure of the hot-rolled sheet according to the invention contains residual austenite in an amount not less than which it is preferred to be rich in carbon and stabilized at an ambient temperature, especially by additions of silicon and aluminium. The residual austenite is present in the form of inter-lath films or islands in the bainite, ranging from a few hundreds of a micron to a few microns in size.

An amount of residual austenite less than 5% does not make it possible for the inter-lath films to increase the resistance to damage significantly.

Preferably, the carbon content of the residual austenite is greater than 1% so as to reduce the formation of carbides and to obtain a residual austenite that is sufficiently stable at ambient temperature.

FIG. 2 shows an example of the microstructure of a steel sheet according to the invention. The residual austenite A, here having an area content of 7%, appears white, in the form of islands or films. The martensite M, here with an area content of 15%, is in the form of a very dark constituent in a bainitic matrix B appearing grey.

Within some of the islands, the local carbon content, and therefore the local quench hardenability, may vary. The residual austenite is then associated locally with martensite within these islands, which are referred to by the term "M-A" islands, which combine martensite and residual austenite. Within the context of the invention, it has been demonstrated that a specific morphology of the M-A islands is particularly sought after. The morphology of the M-A islands may be revealed by means of suitable chemical reactants known per se. After chemical etching, the M-A islands appear for example white in a relatively dark bainitic matrix. These islands are observed by optical microscopy at magnifications ranging from about 500× to 1500× over an area having a statistically representative population. The maximum size $L_{max}$ and minimum size $L_{min}$ of each of the islands is determined for example by means of image analysis software known per se, such as for example the Visilog® software from Noesis. The ratio of maximum size to minimum size $L_{max}/L_{min}$ characterizes the elongation factor of a given island. According to the invention, particularly high ductility is obtained by reducing the number $N_{MA}$ of M-A islands having a maximum length $L_{max}$ greater than 2 microns and having an elongation factor less than 4. These large bulky islands prove to be preferential initiation zones during subsequent mechanical stressing. According to the invention, the number of islands $N_{MA}$ per unit area must be less than 14,000/mm$^2$.

The structure of the steels according to the invention also contains, complementing the bainite and residual austenite, martensite in an amount equal to or greater than 2%. This feature allows additional hardening, thereby achieving a tensile strength greater than 1200 MPa.

Preferably, the number of carbides located in inter-lath positions, which are generally coarser, with a size greater than 0.1 microns, is limited. These carbides may be observed for example under an optical microscope at a magnification of 1000× or higher. It has been demonstrated that N, the number of inter-lath carbides with a size greater than 0.1 microns per unit area, must be less than 50,000/mm$^2$, otherwise damage becomes excessive during subsequent stressing, for example in hole expansion tests. In addition, excessive presence of carbides may be the cause of premature fracture initiation and of a reduction in toughness.

The process for manufacturing a hot-rolled sheet according to the invention is implemented as follows:

- a steel of composition according to the invention is supplied;

a semi-finished product is cast from this steel. This casting may be carried out as ingots, or continuously in the form of slabs with a thickness of around 200 mm. The semi-finished product may also be cast in the form of thin slabs a few tens of millimeters in thickness, or thin strip by being cast between counter-rotating steel rolls;

the cast semi-finished products are firstly heated, to a temperature above 1150° C. so as to reach, at all points, a temperature favourable to high deformations that the steel will undergo during rolling. Of course, in the case of direct casting of thin slabs or thin strip between counter-rotating rolls, the step of hot-rolling these semi-finished products starting at above 1150° C. may be carried out directly after casting, so that an intermediate reheat step is unnecessary in this case;

the semi-finished product is hot-rolled in a temperature range in which the structure of the steel is completely austenitic up to an end-of-rolling temperature $T_{FL}$, with reference to the appended FIG. 1. This figure shows a thermomechanical manufacturing diagram 1 according to the invention and a transformation diagram indicating the ferrite transformation region 2, the bainite transformation region 3 and the martensite transformation region 4; and a controlled cooling step is then carried out, starting at a temperature $T_{DR}$, lying above Ar3 (the austenite-to-ferrite transformation start temperature), and finishing at a temperature $T_{FR}$ (the end-of-cooling temperature). The mean cooling rate between $T_{DR}$ and $T_{FR}$ is equal to $V_R$. This cooling and the associated rate $V_R$ are termed primary cooling and primary cooling rate. According to the invention, the rate $V_R$ is between 50 and 90° C./s. When the cooling rate is less than 50° C./s, proeutectoid ferrite forms, this being deleterious to obtaining high strength properties. According to the invention, the austenite-to-ferrite transformation is thus avoided. When the rate $V_R$ is greater than 90° C./s, there is a risk of forming martensite and causing a heterogeneous structure to appear. The cooling range according to the invention is advantageous from an industrial standpoint as it is unnecessary for the sheet to be cooled very rapidly after hot rolling, for example at a rate of about 200° C./s. This avoids the need for costly specific installations. The range of cooling rates according to the invention may be obtained by spraying water or a water/air mixture, depending on the thickness of the sheet.

The process may also be implemented according to the following variant. Starting from the temperature $T_{DR}$, a steel is rapidly cooled down to a temperature $T_I$ of 650° C. or below. The rate $V_{R1}$ of this rapid cooling is greater than 70° C./s. The steel is then cooled down to a temperature $T_{FR}$ in such a way that the average cooling rate between $T_{DR}$ and $T_{FR}$ is between 20 and 90° C./s. This variant has the advantage of requiring slower cooling on average between $T_{DR}$ and $T_{FR}$ than in the previous variant, provided that more rapid cooling at the rate $V_{R1}$ from $T_{DR}$ is carried out in order to guarantee the absence of proeutectoid ferrite.

After this first rapid cooling phase carried out according to either of the above two variants, a slower cooling phase is carried out, called secondary cooling, which starts at a temperature $T_{FR}$ between $B'_s$ and $M_s$+50° C. and which ends at ambient temperature. The secondary cooling rate is denoted by $V'_R$. The martensite transformation start temperature is denoted by $M_s$. The temperature $B'_s$ is defined relative to the temperature $B_s$, the bainite transformation start temperature, in the following way:

when, very slow secondary cooling is carried out at a rate $V'_R$ between 0.08° C./min and 2° C./min, $B'_s=B_s$, the bainite transformation start temperature. This temperature $B_s$ may be determined experimentally or evaluated from the composition by means of formulae known per se. FIG. 1 illustrates this first method of manufacture;

when, starting from $T_{FR}$, the hot-rolled sheet is cooled at a rate $V'_R$ greater than 2° C./min but not exceeding 600° C./min, $B'_s=B_s$+60° C.

The first case corresponds to the manufacture of the thinnest sheets, down to about 15 mm, which are hot coiled and then slowly cooled after the coiling operation. The second case corresponds to the manufacture of thicker sheets that are not hot-coiled. Depending on the sheet thickness, cooling rates greater than 2° C./min but not exceeding 600° C./min correspond to slightly accelerated cooling or to air cooling.

When the end-of-cooling temperature is above $B'_s$, the carbon enrichment of the austenite is insufficient. After complete cooling, carbides or martensite islands are formed. In this way, it is possible to obtain a steel having a dual-phase structure, but the combination of properties (strength/ductility) of which is inferior to that of the invention. These structures also have a greater sensitivity to damage than those of the invention.

When the end-of-cooling temperature is below $M_s$+50° C., carbon enrichment of the austenite is excessive. Under certain industrial conditions, there is a risk of forming a pronounced banded structure and of excessive martensite transformation.

Thus, under the conditions according to the invention, the process has a low sensitivity to variation in the manufacturing parameters.

The secondary cooling associated with a temperature $T_{FR}$ between $B'_s$ and $M_s$+50° C. allows the austenite-to-bainite transformation to be controlled, locally enriches this austenite so as to stabilize it, and enables a suitable (bainite/residual austenite/martensite) ratio to be obtained.

Within the context of the invention, it is also possible to adjust the primary cooling rate $V_R$ between $T_{DR}$ and $T_{FR}$, the end-of-cooling temperature and the secondary cooling rate $V'_R$ in such a way that the microstructure of the steel consists of at least 75% bainite, residual austenite in an amount equal to 5% or greater and martensite in an amount equal to 2% or greater.

The parameters $T_{DR}$, $T_{FR}$, $V_R$ and $V'_R$, adjusted so as to obtain at least 75% bainite, at least 5% austenite and at least 2% martensite, will be chosen in the following manner:

$T_{DR}$ will be chosen to be above $A_{R3}$ so as to avoid the formation of proeutectoid ferrite, while still preventing excessive austenitic grain growth, and to refine the final microstructure;

the cooling rate will be chosen so as to be as rapid as possible, so as to avoid a pearlite transformation (which would result in an insufficient residual austenite content) and ferrite transformation, while still remaining within the control capabilities of an industrial line so as to obtain microstructural homogeneity in the longitudinal and transverse directions of the hot-rolled sheet. However, the cooling rate $V_R$ must be limited so as to avoid the formation of a microstructure that is heterogeneous over the thickness of the sheet;

the cooling rate $V'_R$ is essentially dependent on the production capabilities of industrial sites and on the sheet thickness;

independently of $V'_R$, $T_{FR}$ will be chosen to be low enough to avoid a pearlite transformation, which would result in an incomplete bainite transformation and a residual austenite content of less than 5%;

in addition, if the cooling rate $V'_R$ is rapid, the temperature $T_{FR}$ will be chosen to be high enough to allow time for the bainite transformation to take place above the martensite region. The formation of more than 20% martensite by too rapid a transition into the martensite region is therefore avoided. The latter transformation would occur at the expense of the bainite transformation and the stabilization of the residual austenite; and if the cooling rate $V'_R$ is slow, a variation in the temperature $T_{FR}$ within the range between $B'_s$ and $M_s$+50° C. would have little influence on the final microstructure.

These parameters may also be adjusted so as to obtain a particular morphology and nature of the M-A islands, in particular chosen so that the number $N_{MA}$ of martensite/residual austenite islands having a size greater than 2 microns and having an elongation factor less than 4 is less than 14,000/mm$^2$. These parameters may also be adjusted so that the carbon content of the residual austenite is greater than 1% by weight. In particular, too high a cooling rate $V_R$ will not be chosen so as to avoid the excessive formation of coarse islands. The parameters $V_R$, $T_{FR}$ and $V'_R$ may also be adjusted so that the number N of bainitic carbides of size greater than 0.1 microns per unit area does not exceed 50,000/mm$^2$.

EXAMPLE

Steels with the compositions given in the table below, expressed as percentages by weight, were smelted. Apart from steels I-1 to I-9 that were used for manufacturing sheets according to the invention, the table indicates, for comparison, the composition of steels R-1 to R-9 that were used to manufacture reference sheets.

Semi-finished products corresponding to the above compositions were heated to 1200° C. and hot rolled down to a thickness of 3 mm or 12 mm in a temperature range in which the structure was entirely austenitic. The cooling start temperatures $T_{DR}$, between 820 and 945° C., were also within the austenitic region. The cooling rates $V_R$ between $T_{DR}$ and $T_{FR}$, the end-of-cooling temperatures $T_{FR}$ and the secondary cooling rates $V'_R$ are indicated in Table 2. Starting from any one composition, certain steels (I-1, I-2, I-5, R-7) were subjected to various manufacturing conditions. The references I-1a, I-1b and I-1c denote, for example, three steel sheets manufactured under different conditions from the steel composition I-1. The steel sheets I-1a to I-1c, I-4, I-5a, I-5b and R-6 have a thickness of 12 mm, the other sheets having a thickness of 3 mm.

Table 2 also indicates the transformation temperatures $B'_s$ and $M_s$+50° C. calculated from the chemical compositions by means of the following expressions, the compositions being expressed in percentages by weight:

$$B_s(°\ C.)=830-270(C)-90(Mn)-37(Ni)-70(Cr)-83(Mo)$$

$$M_s(°\ C.)=561-474(C)-33(Mn)-17(Ni)-17(Cr)-21(Mo)$$

Also indicated are the various microstructural constituents measured by quantitative microscopy: fraction per unit area of bainite, of residual austenite by X-ray diffraction or by magnetic saturation measurement, and of martensite. The M-A islands were demonstrated with Klemm reagent. Their morphology was examined by means of image analysis software so as to determine the parameter $N_{MA}$. In certain eases, the possible presence of carbides with, a size greater than 0.1 microns within the bainite phase was examined by means of Nital etching and observation under an optical microscope at high magnification. The number N (per mm$^2$) of inter-lath carbides larger in size than 0.1 microns was determined.

TABLE 1

| Steel compositions (wt %): | | | | | | | | | | |
|---|---|---|---|---|---|---|---|---|---|---|
| Steel | C (%) | M (%) | Si (%) | Al (%) | Si + Al (%) | Mo (%) | Cr (%) | Cr + (3 × Mo) (%) | S (%) | P (%) |
| I-1 | 0.21 | 1.56 | 1.46 | 0.025 | 1.485 | 0.245 | 1.49 | 2.21 | <0.003 | <0.015 |
| I-2 | 0.185 | 2.29 | 1.49 | 0.025 | 1.515 | 0.26 | — | 0.78 | <0.003 | <0.015 |
| I-3 | 0.185 | 2 | 1.5 | 0.025 | 0.525 | 0.25 | 1.49 | 2.24 | <0.003 | <0.015 |
| I-4 | 0.215 | 2.05 | 1.5 | 0.025 | 1.525 | 0.245 | 1.49 | 2.25 | <0.003 | <0.015 |
| I-5 | 0.22 | 2.28 | 1.5 | 0.025 | 1.5 | 0.255 | — | 0.765 | <0.003 | <0.015 |
| I-6 | 0.18 | 1.59 | 1.43 | 0.025 | 1.455 | 0.24 | 0.76 | 1.56 | <0.003 | <0.015 |
| I-7 | 0.19 | 2.29 | 1.49 | 0.025 | 1.515 | 0.26 | — | 0.78 | <0.003 | <0.015 |
| I-8 | 0.10 | 2.23 | 1.46 | 0.019 | 1.479 | 0.255 | 0.645 | 1.41 | 0.004 | 0.025 |
| I-9 | 0.20 | 2.00 | 1.5 | 0.025 | 1.525 | 0.14 | 0.34 | 0.76 | <0.003 | <0.015 |
| R-1 | 0.197 | 1.48 | 1.5 | 0.025 | 1.525 | — | — | —(*) | <0.003 | <0.015 |
| R-2 | 0.196 | 1.87 | 1.5 | 0.025 | 1.525 | 0.19 | — | 0.57 | <0.003 | <0.015 |
| R-3 | 0.2 | 1.5 | 1.5 | 0.025 | 1.525 | — | 0.4 | 0.4 | <0.003 | <0.015 |
| R-4 | 0.195 | 1.53 | 1.42 | 0.048 | 1.468 | 0.295 | — | 0.885 | <0.003 | <0.015 |
| R-5 | 0.18 | 1.48 | 1.39 | 0.04 | 1.43 | 0.29 | — | 0.87 | 0.003 | 0.002 |
| R-6 | 0.285(*) | 2.25 | 1.5 | 0.025 | 1.525 | 0.255 | — | 0.765 | <0.003 | <0.015 |
| R-7 | 0.29(*) | 1.59 | 1.55 | 0.025 | 1.575 | 0.25 | 0.75 | 1.5 | <0.003 | <0.015 |
| R-8 | 0.547(*) | 1.49 | 1.52 | 0.04 | 1.56 | — | — | —(*) | <0.003 | <0.015 |
| R-9 | 0.195 | 1.53 | 1.42 | 0.05 | 1.47 | 0.3 | — | 0.9 | <0.003 | <0.015 |

I = according to the invention;

R = reference (*)not according to the invention.

TABLE 2

Manufacturing conditions and microstructure of the hot-rolled sheets obtained.

| Steel Sheet (thickness) | $V_R$ (° C./s) | $T_{FR}$ (° C.) | $V'_R$ | $B'_s$ (° C.) | $M_s$ + 50° (° C.) | Bainite (%) | Residual austenite (%) | Martensite (%) | No. of carbides (per mm$^2$) |
|---|---|---|---|---|---|---|---|---|---|
| I-1a (12 mm) | 56 | 509 | 50° C./min | 508 + 60 | 430 | 75 | 11 | 14 | n.d. |
| I-1b (12 mm) | 50 | 563 | 50° C./min | 508 + 60 | 430 | 80 | 12 | 6 | n.d. |
| I-1c (12 mm) | 57 | 450 | 50° C./min | 508 + 60 | 430 | n.d. | n.d. | n.d. | n.d. |
| I-2a (3 mm) | 50 | 450 | 0.33° C./min | 553 | 442 | 78 | 7 | 15 | 20000 |
| I-2b (3 mm) | 50 | 500 | 0.33° C./min | 553 | 442 | 78 | 5. | 18 | 41000 |
| I-3 (3 mm) | 50 | 450 | 0.33° C./min | 475 | 429 | n.d. | 7 | n.d. | 42000 |
| I-4 (12 mm) | 74 | 471 | 50° C./min | 462 + 60 | 411 | n.d. | n.d. | n.d. | n.d. |
| I-5a (12 mm) | 52 | 495 | 50° C./min | 546 + 60 | 428 | 85 | 9 | 6 | n.d. |
| I-5b (12 mm) | 59 | 554 | 50° C./min | 546 + 60 | 428 | 86 | 9 | 5 | n.d. |
| I-6 (3 mm) | 50 | 455 | 0.33° C./min | 565 | 455 | n.d. | 7.6 | n.d. | n.d. |
| I-7 (3 mm) | 50 | 450 | 0.33° C./min | 551 | 440 | 75 | 5 | 20 | 26000 |
| I-8 (3 mm) | 80 | 500 | 0.33° C./min | 534 | 473 | 75 | n.d | n.d | 25000 |
| I-9 (3 mm) | 50 | 485 | 0.33° C./min | 561 | 441 | n.d | n.d | n.d | n.d |
| R-1 (3 mm) | 200(*) | 400(*) | 0.33° C./min | 644 | 469 | 89 | 11 | —(*) | 0 |
| R-2 (3 mm) | 200(*) | 400(*) | 0.33° C./min | 593 | 452 | 88 | 12 | —(*) | 0 |
| R-3 (3 mm) | 200(*) | 400(*) | 0.33° C./min | 613 | 460 | 86 | 14 | —(*) | 0 |
| R-4 (3 mm) | 100(*) | 500 | 0.33° C./min | 615 | 462 | 70(*) | 7 | 23 | >50000(*) |
| R-5 (3 mm) | 100(*) | 400(*) | 0.33° C./min | 605 | 462 | 74(*) | 12 | 14 | 0 |
| R-6 (12 mm) | 48 | 450 | 50° C./min | 529 + 60 | 396 | 63 | 0 | 37 | n.d. |
| R-7a (3 mm) | 50 | 450 | 0.33° C./min | 535 | 403 | n.d. | 10 | n.d. | n.d. |
| R-7b (3 mm) | 50 | 350(*) | 0.33° C./min | 535 | 403 | n.d. | 11 | n.d. | n.d. |
| R-8 (3 mm) | 30(*) | 450 | 0.33° C./min | 548 | 303 | 96 | 4(*) | —(*) | n.d. |
| R-9 (3 mm) | 300(*) | 20(*) | 0.33° C./min | 615 | 462 | —(*) | —(*) | 100 | n.d. |

I = according to the invention;
R = reference
(*)Not according to the invention.
n.d.: not determined The tensile properties obtained (yield strength $R_e$, tensile strength $R_m$, uniform elongation $A_u$ and elongation at break $A_b$ are given in Table 3 below. The $R_e/R_m$ ratio is also indicated. In certain cases, the fracture energy $K_{cv}$ at 20° C. was determined on V-notch toughness specimens.

In addition, the damage due to cutting (for example shearing or punching), which could possibly reduce the subsequent deformability of a cut part, was evaluated. For this purpose, specimens measuring 20×80 mm$^2$ were cut by shearing. Some of these specimens were then, polished on their edges. The specimens were then coated with photodeposited meshes and then subjected to a uniaxial tensile test until fracture. The principal strains $\varepsilon_1$ parallel to the stressing direction were measured as close as possible to fracture initiation from the deformed meshes. This measurement was carried out on specimens having mechanically cut edges and on specimens having polished edges. The cutting sensitivity was evaluated by the damage factor Δ, where $\Delta=[\varepsilon_1(\text{cut edges})-\varepsilon_1(\text{polished edges})]/\varepsilon_1(\text{polished edges})$.

The weldability for arc welding (MAG process) and for spot resistance welding of these steel sheets was also determined.

TABLE 3

Mechanical properties of the hot rolled sheets obtained.

| Steel sheet | Re (MPa) | Rm (MPa) | Re/Rm | Au (%) | Ab(%) | KCV (20° C.) Joules) | Δ(%) |
|---|---|---|---|---|---|---|---|
| I-1a | 850 | 1322 | 0.643 | 6.5 | 13.3 | 48 | n.d. |
| I-1b | 864 | 1307 | 0.661 | 6.2 | 14.5 | 44 | n.d. |
| I-1c | 789 | 1343 | 0.587 | 6.1 | 12.6 | 28 | n.d. |
| I-2a | 747 | 1262 | 0.592 | 6.9 | 12.5 | n.d. | n.d. |
| I-2b | 718 | 1209 | 0.594 | 7.8 | 10.8 | n.d. | n.d. |
| I-3 | 863 | 1384 | 0.624 | 7.5 | 12.4 | n.d. | −13% |

TABLE 3-continued

Mechanical properties of the hot rolled sheets obtained.

| Steel sheet | Re (MPa) | Rm (MPa) | Re/Rm | Au (%) | Ab(%) | KCV (20° C.) Joules) | Δ(%) |
|---|---|---|---|---|---|---|---|
| I-4 | 977 | 1469 | 0.665 | 5.2 | 15.9 | 49 | n.d. |
| I-5a | 994 | 1382 | 0.719 | 4.4 | 13.2 | 86 | n.d. |
| I-5b | 914 | 1299 | 0.704 | 4.8 | 13.9 | 52 | n.d. |
| I-6 | 832 | 1281 | 0.649 | 8.7 | 13.0 | n.d. | n.d. |
| I-7 | 734 | 1306 | 0.562 | 6.1 | 10.0 | n.d. | −12% |
| I-8 | 728 | 1200 | 0.606 | 6.1 | 10.0 | n.d | n.d |
| I-9 | 645 | 1200 | 0.537 | 8.4 | 12.9 | n.d | n.d |
| R-1 | 709 | 801(*) | 0.885(*) | 12.9 | 19.0 | n.d. | n.d. |
| R-2 | 728 | 864(*) | 0.843(*) | 15.7 | 23.8 | n.d. | n.d. |
| R-3 | 773 | 912(*) | 0.847(*) | 13.8 | 22.5 | n.d. | n.d. |
| R-4 | 629 | 890(*) | 0.707 | 17.3 | 17.7 | n.d. | −48% |
| R-5 | 585 | 857(*) | 0.682 | 16.6 | 20.2 | n.d. | n.d. |
| R-6 | 725 | 1290 | 0.562 | 6.7 | 11.5 | 14(*) | n.d. |
| R-7a | 782 | 1231 | 0.635 | 11.7 | 16.6 | <28(*) | n.d. |
| R-7b | 961 | 1297 | 0.741 | 6.9 | 12.2 | <28(*) | n.d. |
| R-8 | 779 | 1048(*) | 0.743 | 8.8 | 13.9 | n.d. | n.d. |
| R-9 | 790 | 1422 | 0.556 | 5.4 | 9.1(*) | n.d. | n.d. |

I = according to the invention;
R = reference.
(*)Not according to the invention.
n.d.: not determined.

Steel sheets I-1 to I-9 according to the invention had a particularly advantageous combination, of mechanical properties, namely on the one hand a tensile strength greater than 1200 MPa and, on the other hand, an elongation at break greater than 10% and an $R_e/R_m$ ratio less than 0.75 ensuring good formability. The steels according to the invention also had a room-temperature Charpy V-notch fracture energy of greater than 28 joules. This high toughness allows the manufacture of parts resistant to the sudden propagation of a defect, especially when stressed dynamically. The microstructures of the steels according to the invention bad a number of islands $N_{MA}$ of less than 14,000/mm$^2$.

In particular, steel sheets I-2a and I-5a had a low proportion of large bulky M-A islands, per unit area, namely 10,500 and 13,600 per mm$^2$ respectively.

The steels according to the invention also had good resistance to damage in the case of cutting, since the damage factor Δ was limited to −12 or −13%.

These steels also exhibited, good weldability in MAG homogeneous welding. For welding parameters suitable for the thicknesses indicated above, the lap welded joints were free from hot or cold cracks. A similar result was observed in homogeneous spot resistance welding.

In the case of steel I-9, the cooling between $T_{DR}$ (880° C.) and (485° C.) (cf. Table 2) was also carried out according to the following variant: after a first cooling phase at a rate $V_{R1}$=80° C./s down to a temperature $T_I$ of 590° C., the sheet was cooled in such a way that the average cooling rate between 880° C. and 485° C. was 37° C./s. The observed mechanical properties were then very similar to those given in Table 3, Example I-9.

Steel R-1 had an insufficient content of chromium and/or molybdenum. The cooling conditions relating to steels R-1 to R-3 ($V_R$ too high and too low) were not suitable for the formation of a fine bainitic structure. The absence of martensite did not allow sufficient hardening, the tensile strength was markedly below 1200 MPa and the $R_e/R_m$ ratio was excessive.

In the case of steel sheets R-4 and R-5, the excessively rapid cooling rate after rolling made it impossible to obtain a sufficiently high amount of bainite. The M-A islands formed were relatively coarse. In the case of steel sheet R-4, the number of compounds was 14,700/mm$^2$. The bainitic fraction and the tensile strength of these steels were insufficient. Steel sheet R-4, containing a large number of carbides (N>50,000/mm$^2$) had an excessively high damage sensitivity as witnessed by the value of the damage factor: Δ=−48%.

Steel R-6 had an excessive carbon content, resulting in too high a martensite content owing to its high quench hardenability. Its bainite content and its austenite content, were insufficient. Steel sheet R-6 consequently had insufficient resistance to sudden propagation of a defect since its Charpy V-notch fracture energy at 20° C. was much lower than 28 joules.

Steel sheets R-7a and R-7b also had an excessive carbon content. The transition temperature at the 28 joules level, estimated from thin test specimens, was above ambient temperature, indicating mediocre toughness. The weldability was reduced. It should be noted that the tensile strength of these steel sheets, despite their higher carbon content, was not higher than that of the steels according to the invention.

Steel sheet R-8f having an excessive carbon content, was cooled too slowly. As a result, the residual austenite was greatly enriched with carbon and the formation of martensite could not take place. The tensile strength obtained was therefore insufficient.

Steel sheet R-9 was cooled at an excessively high rate down to too low an end-of-cooling temperature. Consequently, the structure was practically entirely martensitic and the elongation at break was insufficient.

Thus, the invention allows the manufacture of steel sheets having a bainitic matrix without the addition of costly microalloying elements. These sheets have both very high tensile strength and high ductility. Thanks to their high tensile strength, these steel sheets are suitable for the manufacture of elements subjected to cyclic mechanical stressing.

The steel sheets according to the invention are advantageously used for the manufacture of structural parts or reinforcing elements in the automotive field and in general industry.

What is claimed is:

1. A process for manufacturing a hot-rolled steel sheet having a tensile strength of greater than 1200 MPa, an $R_e/R_m$ ratio of less than 0.75 and an elongation at break of greater than 10%, the process comprising the steps of:

supplying a steel composition comprising, the contents being expressed by weight:

0.10%≤C≤0.25%;

1%≤Mn≤3%;

Al≥0.015%;

Si≤1.985%;

Mo≤0.30%;

0.3%≤Cr≤1.5%;

S≤0.015%;

P≤0.1%;

Co≤1.5%;

B≤0.005%;

wherein 1%≤Si+Al≤2% and Cr+(3×Mo)≥0.3%, and a balance of the steel composition includes iron and inevitable impurities resulting from smelting;

casting a semi-finished product from the steel composition;

heating said semi-finished product to a temperature above 1150° C.;

hot-rolling said semi-finished product in a temperature range in which the microstructure of the steel is entirely austenitic; then cooling the sheet thus obtained from a temperature $T_{DR}$ lying above Ar3 down to a transformation temperature $T_{FR}$ in such a way that the primary cooling rate $V_R$ between $T_{DR}$ and $T_{FR}$ is between 50 and 90° C./s and the temperature $T_{FR}$ is between $B'_S$ and $M_S$+50° C., $B'_s$ denoting a temperature defined relative to the bainite transformation start temperature $B_s$, and $M_s$ denoting the martensite transformation start temperature, then cooling said sheet from the temperature $T_{FR}$ at a secondary cooling rate $V'_R$ between 0.08° C./mm and 600° C./min down to the ambient temperature;

said temperature B's being equal to $B_s$ when said rate $V'_R$ is between 0.08 and 2° C./min; and said temperature B's being equal to $B_s$+60° C. when said rate $V'_R$ is greater than 2° C./min but does not exceed 600° C./min.

2. A process for manufacturing a hot-rolled steel sheet according to claim 1, wherein the balance of the steel composition consists of iron and inevitable impurities resulting from smelting.

3. The process according to claim 1, wherein the primary cooling start temperature $T_{DR}$ lying above Ar3, the primary cooling finish temperature $T_{FR}$, the primary cooling rate $V_R$ between $T_{DR}$ and $T_{FR}$ and the secondary cooling rate $V'_R$ are adjusted in such a way that the number of inter-lath carbides having a size greater than 0.1 microns per unit area does not exceed 50,000/mm$^2$.

4. The process according to claim 1, wherein the primary cooling start temperature $T_{DR}$ lying above Ar3, the primary cooling finish temperature $T_{FR}$, the primary cooling rate $V_R$ between $T_{DR}$ and $T_{FR}$ and the secondary cooling rate $V'_R$ are adjusted in such a way that the number $N_{ma}$ per unit area of martensite/residual austenite islands having a maximum size $L_{max}$ greater than 2 microns and an elongation factor $L_{max}/L_{min}$ less than 4 is less than 14,000/mm$^2$.

5. A method of manufacturing a structural part or reinforcing element suitable for an automobile, the method comprising the step of:

forming a hot-rolled steel sheet according to claim 1 into a structural part or reinforcing elements.

6. A method of manufacturing an article, the method comprising the step of:

forming a hot-rolled steel sheet according to claim 1.

7. The process according to claim 1, wherein the primary cooling start temperature $T_{DR}$ lying above Ar3, the primary cooling finish temperature $T_{FR}$, the primary cooling rate $V_R$ between $T_{DR}$ and $T_{FR}$ and the secondary cooling rate $V'_R$ are adjusted in such a way that the carbon content of the residual austenite is greater than 1% by weight.

8. A process for manufacturing a hot-rolled steel sheet having a tensile strength of greater than 1200 MPa, an $R_e/R_m$ ratio of less than 0.75 and an elongation at break of greater than 10%, the process comprising:

supplying a steel composition comprising, the contents being expressed by weight:

0.10%≤C≤0.25%;

1%≤Mn≤3%;

Al≥0.015%;

Si≤1.985%;

Mo≤0.30%;

0.3%≤Cr≤1.5%;

S≤0.015%;

P≤0.1%;

Co≤1.5%;

B≤0.005%;

wherein 1%≤Si+Al≤2% and Cr+(3×Mo)≥0.3%, and a balance of the composition includes iron and inevitable impurities resulting from smelting;

casting a semi-finished product from the steel composition;

heating said semi-finished product to a temperature above 1150° C.;

hot-rolling said semi-finished product in a temperature range in which the microstructure of the steel is entirely austenitic; then cooling the sheet thus obtained from a temperature $T_{DR}$ lying above Ar3 down to an intermediate temperature $T_I$ at a cooling rate $V_{R1}$ of 70° C./s or higher, said temperature $T_I$ not exceeding 650° C.; then cooling said sheet from said temperature $T_I$ down to a temperature $T_{FR}$, said temperature $T_{FR}$ being between B's and $M_s$+50° C., B's denoting a temperature defined relative to the bainite transformation start temperature Bs, and $M_s$ denoting the martensite transformation start temperature, in such a way that the cooling rate between said temperature $T_{DR}$ and said temperature $T_{FR}$ is between 20 and 90° C./s; then cooling said sheet from the temperature $T_{FR}$ at a secondary cooling rate $V'_R$ between 0.08° C./min and 600° C./min down to the ambient temperature;

said temperature B's being equal to $B_s$ when said rate $V'_R$ is between 0.08 and 2° C./min; and said temperature B's being equal to $B_s$+60° C. when said rate $V'_R$ is greater than 2° C./min but does not exceed 600° C./min.

9. A process for manufacturing a hot-rolled steel sheet as recited in claim 7, wherein the balance of the steel composition consists of iron and inevitable impurities resulting from smelting.

10. A process for manufacturing a hot-rolled steel sheet, the process comprising supplying a steel composition comprising, the contents being expressed by weight:

0.10%≤C≤0.25%;

1%≤Mn≤3%;

Al≥0.015%;

Si≤1.985%;

Mo≤0.30%;

0.3%≤Cr≤1.5%;

S≤0.015%;

P≤0.1%;

Co≤1.5%;

B≤0.005%;

wherein 1%≤Si+Al≤2% and Cr+(3×Mo)≥0.3%, and a balance of the composition includes iron and inevitable impurities resulting from smelting;

casting a semi-finished product from the steel;

heating said semi-finished product to a temperature above 1150° C.;

hot-rolling said semi-finished product in a temperature range in which the structure of the steel is entirely austenitic; then the primary cooling start temperature $T_{DR}$ lying above Ar3, the primary cooling finish temperature $T_{FR}$, the primary cooling rate $V_R$ between $T_{DR}$ and $T_{FR}$ and the secondary cooling rate $V'_R$ are adjusted in such a way that the microstructure of said steel consists of at least 75% bainite, residual austenite in an amount equal to or greater than 5% and martensite in an amount equal to or greater than 2%.

11. A process for manufacturing a hot-rolled steel sheet as recited in claim 9, wherein the balance of the steel composition consists of iron and inevitable impurities resulting from smelting.

* * * * *